United States Patent [19]

Wood et al.

[11] Patent Number: 4,527,625

[45] Date of Patent: Jul. 9, 1985

[54] PACKER VALVE ARRANGEMENT

[75] Inventors: Edward T. Wood, Kingwood; Ernest O. Sodich, Caldwell, both of Tex.

[73] Assignee: Completion Tool Company, Houston, Tex.

[21] Appl. No.: 617,886

[22] Filed: Jun. 6, 1984

Related U.S. Application Data

[63] Continuation of Ser. No. 441,564, Nov. 15, 1982, abandoned.

[51] Int. Cl.[3] ..... E21B 33/12

[52] U.S. Cl. ..... 166/187; 277/34

[58] Field of Search ..... 166/187, 151; 277/34, 277/34.3, 34.6, 29, 187

[56] References Cited

U.S. PATENT DOCUMENTS

| | | | |
|---|---|---|---|
| 3,527,296 | 9/1970 | Malone | 166/122 |
| 4,260,164 | 4/1981 | Baker et al. | 166/187 X |
| 4,402,517 | 9/1983 | Wood et al. | 166/187 X |
| 4,420,159 | 12/1983 | Wood | 166/187 X |

FOREIGN PATENT DOCUMENTS

| | | | |
|---|---|---|---|
| 878900 | 8/1971 | Canada | 277/29 |

*Primary Examiner*—Stephen J. Novosad
*Assistant Examiner*—Thuy M. Bui

[57] ABSTRACT

A valve system for use in inflating packers mounted on mandrels is disclosed. The valve system uses one valve to permit, through the use of seals, the flow of fluid from the interior of a tubular mandrel to the interior of the inflatable packer when pressure applied in the mandrel exceeds at least a minimum pressure.

7 Claims, 5 Drawing Figures

Fig. 1
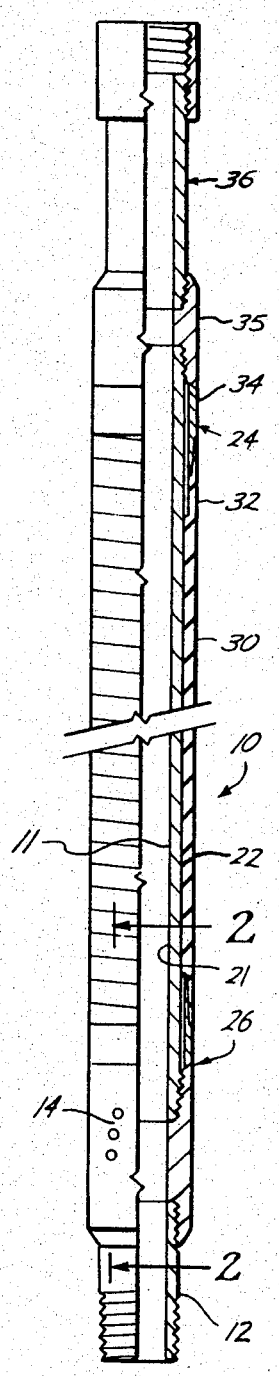
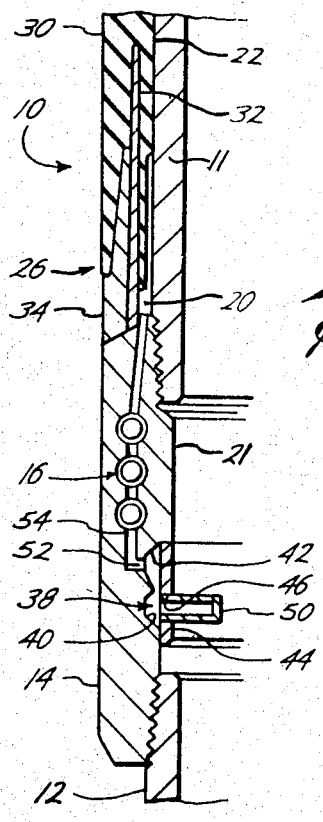
Fig. 2

Fig. 3A
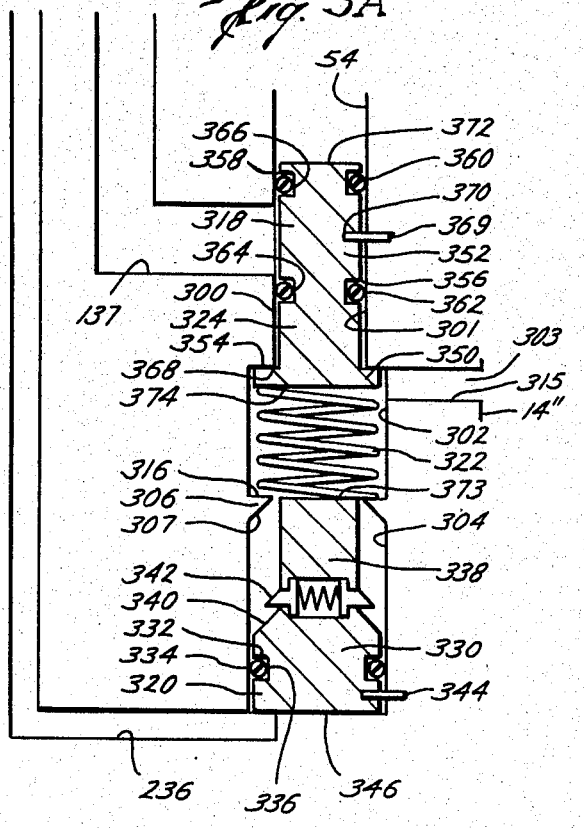
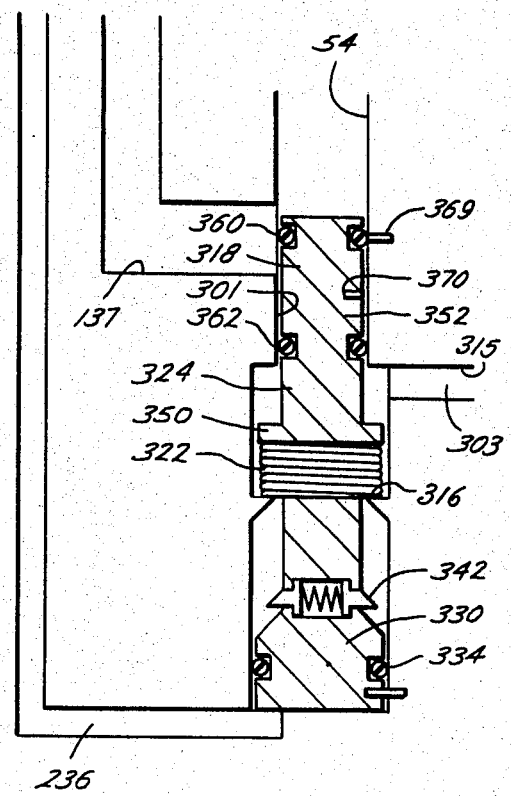
Fig. 3B
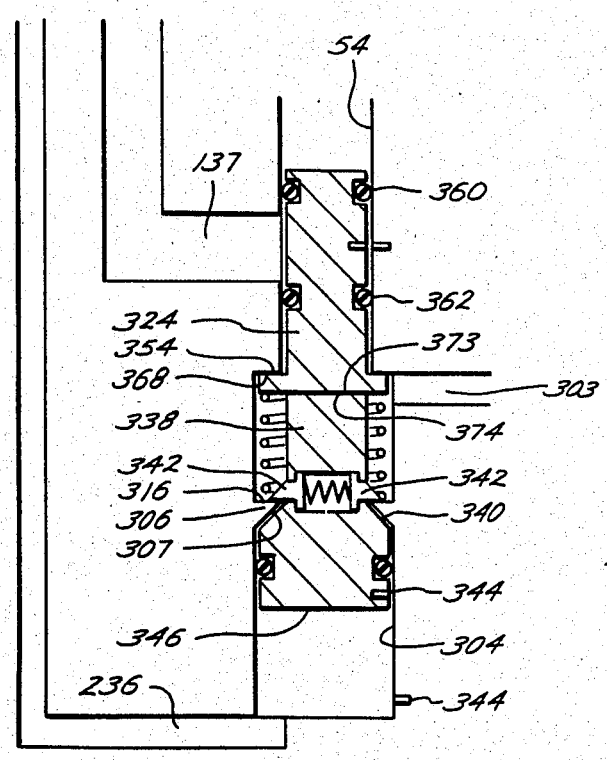
Fig. 3C

PACKER VALVE ARRANGEMENT

This application is a continuation application based upon the applicants pending application Ser. No. 441,564, filed Nov. 15, 1982 and assigned to Completion Tool Company.

This application is related in subject matter to U.S. Pat. Nos. 4,420,159 and 4,402,517 which were copending with this prior application.

BACKGROUND OF THE INVENTION

1. Field of the Invention

The present invention relates to packer inflation systems and more particularly to the valves which control the inflation of packers.

2. Description of the Prior Art

The control of the inflation of well packers is important to obtain integrity between the packer and the well bore for purposes of working within the bore. It is known in the art to inflate packers by various mechanisms. See, for example, U.S. Pat. No. 3,503,445, issued Mar. 31, 1970, to K. L. Cochran et al, entitled "Well Control During Drilling Operations"; U.S. Pat. No. 3,351,349, issued Nov. 7, 1967, to D. V. Chenoweth, entitled "Hydraulically Expandable Well Packer"; U.S. Pat. No. 3,373,820, issued Mar. 19, 1968, to L. H. Robinson, Jr. et al, entitled "Apparatus for Drilling with a Gaseous Drilling Fluid".

In U.S. Pat. No. 3,437,142, issued Apr. 8, 1969, to George E. Conover, entitled "Inflatable Packer for External Use on Casing and Liners and Method of Use", there is disclosed an inflatable packer for external use on tubular members such as casings, liners, and the like. A valving arrangement is disclosed therein for containing fluid within the interior of the inflatable member after it has been inflated to prevent its return to the tubular member.

Arrangements of valving have been known in the prior art to prevent further communication between the interior of the tubular member and the interior of the inflatable element after the inflatable element has been inflated and set in a well bore. See, for example, U.S. Pat. No. 3,427,651, issued Feb. 11, 1969, to W. J. Bielstein et al, entitled "Well Control"; U.S. Pat. No. 3,542,127, issued Nov. 24, 1970, to Billy C. Malone, entitled "Reinforced Inflatable Packer with Expansible Back-up Skirts for End Portions"; U.S. Pat. No. 3,581,816, issued June 1, 1971, to Billy C. Malone, entitled "Permanent Set Inflatable Element"; U.S. Pat. No. 3,818,922, issued June 25, 1974, to Billy C. Malone, entitled "Safety Valve Arrangement for Controlling Communication Between the Interior and Exterior of a Tubular Member"; and U.S. Pat. No. 3,776,308, issued Dec. 4, 1973, to Billy C. Malone, entitled "Safety Valve Arrangement for Controlling Communication Between the Interior and Exterior of a Tubular Member".

Inflatable packers have also been used in other operations, such as sealing the annular space between a jacket and a piling. See for example U.S. Pat. No. 4,063,427, issued Dec. 20, 1977, to Erwin E. Hoffman, entitled "Seal Arrangement and Flow Control Means Therefor".

The seals that are used in valves, such as in Malone, are usually hardened rubber. Such rubber tends to extrude under extreme pressure differential across the rubber and cause friction between rubber and metal that adversely affects valve operation. None of the prior art, however, provides for mechanism for equalizing pressures across the seals of the valves used to inflate packers to prevent such extrusion.

SUMMARY OF THE INVENTION

The present invention utilizes a unique arrangement of sealing mechanisms in conjunction with a valve or valves to permit the inflation of an inflatable packer element while at the same time equalizing pressure around the rubber seals of the valve or valves to prevent distortion of the seals from undue high differential pressure, and the resulting friction.

The present invention, like the prior art, is constructed and arranged so that the valve or valves remain seated to prevent communication between the interior of a tubular member and the interior of an inflatable element carried on the exterior of the tubular member until at least a predetermined pressure has been reached. This reduces the possibility of premature inflation of the inflatable element by sudden pressure changes or pressure surges which may occur within the tubular member as the tubular member is being positioned within a well bore.

However, the valve arrangement of the inflation system of the present invention includes an appropriate arrangement of the valve structure to compensate for bore pressure to prevent extrusion from undue high differential pressures across the seals of certain rubber seals which must move in the valving operation.

BRIEF DESCRIPTION OF THE DRAWINGS

For further understanding of the nature and objects of the present invention, reference should be had to the following detailed description, taken in conjunction with the accompanying drawings, in which like parts are given like reference numerals and wherein:

FIG. 1 is a cross-section of a packer showing the three-valve collar for inflation of the packing;

FIG. 2 is an enlarged cross-section of the valve arrangement of FIG. 1 taken along section line 2—2 of FIG. 1;

FIGS. 3A–C are pictoral views of the cross-section of the valve arrangement of the present invention showing the valve and the sequence of steps for inflation of the packer shown inverted to the normal position of insertion.

DETAILED DESCRIPTION OF THE PREFERRED EMBODIMENTS

A tubular inflatable packer 10 is shown in FIGS. 1 and 2. This type of packer is specifically illustrated for a three valve embodiment and may be a casing packer as illustrated in copending application Ser. Nos. 407,898 and 408,123, filed Aug. 13, 1982 entitled "Packer Valve Arrangement" by Edward T. Wood and Edward T. Wood/Robert E. Snyder, respectively. Now U.S. Pat. Nos. 4,420,159 and 4,402,517 respectively. However, it should be understood that only one valve pocket is needed in the present invention although additional poppet or check valves could be included. The tubular inflatable packer 10 includes a short casing joint or casing sub 12 for connection to other tubular members and is secured by suitable means, such as threads as illustrated in FIG. 1, to a valve collar 14 secured to a tubular pipe member or mandrel 11. It should be noted that in one aspect of the present invention, the valve collar 14 could also be and is preferably secured to the sub 36 of other end of tubular pipe member 11. The valve collar 14 includes a valve mechanism 16 or system of valves and passageways (See FIG. 2) for placing fluid in the bore 21 of the pipe member 11 in fluid communication with a fluid channel or chamber 20 (See FIG. 2) under the inflatable packing element 30 carried externally on the tubular pipe member 11.

The inflatable packing element 30 includes spaced apart annular packer heads 24, 26. The head 26 is secured to the valve collar 14 while the upper head 24 is secured to a top or upper collar 35. The inflatable packing element 30 extends between the packer heads 24, 26 and is also secured to the pipe member 11 which extends along the inside surface of the packing element 30 between the valve collar 14 and the upper collar 35. The inflatable packing element 30 may be of any suitable length and is an elastomer cover and two sets of steel anti-extrusion ribs 32. The ribs 32 are connected to the elastomer cover, such as, for example, by vulcanizing the elastomer cover to the ribs 32 so that the ribs 32 extend into the ends of the elastomer cove. Each set of ribs 32 is connected to a steel back-up sleeve 34, and one set is connected to the valve collar 14 while the other set is connected to the valve collar 35. Sleeve 34 is also connected to the elastomer cover, such as vulcanized with the rubber, and to the valve collar 14. A tubular sub 36 is connected to the valve collar 35 for use with other tubular members in a string of pipe or casing (not shown).

As shown in FIG. 2, a first set of annular grooves 38 is formed in the valve collar 14. The set of grooves 38 includes internal, circumferential or annular grooves 40, 42 spaced longitudinally apart from one another and covered by juxtaposed screen sleeve 44. The screen sleeve 44 includes a hole 46 which receives a knock-off rod or plug 50, usually constructed of plastic, to isolate the valve system from fluid under pressure in the bore 21 of the pipe member during running of the inflatable packer 10 into a well bore containing fluid.

A port 52 extends partially through the wall of the valve collar 14 and connects a passageway 54 to the groove 42. The passageway 54 extends vertically in the wall of valve collar 14 between a valve in the valve mechanism 16 and the port 56 (See FIG. 2).

It should be noted that the valve collar is located at the upper end of the tubular member 10 instead of the lower end. In this manner, pressure cannot be trapped between, for example, the well bottom and the packer 30 which would have an effect on the differential pressure across the valve thereby preventing the valve from closing.

Referring to FIG. 3A, there is diagramatically shown an embodiment which utilizes a single inflation control valve in a single valve pocket 300. The valve pocket 300 is bored into a valve collar 14" (the double prime is used to denote a different collar than collar 14 with substantially the same pocket and passageway configuration, between the interior of the pipe member 21, the exterior of the valve body and the channel 20 to the interior of the packing element 30, except having one valve pocket and except as otherwise described in the description of this embodiment) or formed in a sleeve or other suitable location. Bore 301, first counterbore 302 and second counterbore 304 are the single valve pocket 300. Counterbores 302 and 304 are separated by stop wings 306, and the counterbores are formed by drilling or other suitable operation in pocket 300. Stop wings 306 form an upwardly facing shoulder 316 with counterbore 302 and a downwardly, outwardly facing shoulder 307 with enlarged counterbore 304. Passageways 54, 303, 137 and 236 are formed in the valve collar 14" to be in communication to bore 21 of the pipe member 11, the external surface of valve collar 14" on the outside of the packer 10, the fluid channel 20 and the interior of the packing element 30, respectively, and to the valve pocket 300. The valve element 318, which is inserted into the valve pocket 300, includes a first valve body member 320 having an upper surface 373 and a lower surface 346 located in a counterbore 304, a spring 322 located in a bore 302, and a second valve body member 324 having upper surface 372 located in bore 301 and a lower surface 374 located in a counterbore 302 in the initial assembled position. Passageway 303 has a lower surface 315 substantially coplaner with spring 322 in the initial assembled position.

First valve body member 320 includes an enlarged valve portion 330 having a groove 332 formed thereabout for reception of a seal 334 therein. Seal 334 is sized to sealingly engage the wall of the counterbore 304 and the bottom surface 336 of the groove 332. Valve stem 338 on the valve body member is of smaller diameter than the valve portion 330 and extends from the valve portion 330 longitudinally to the end of the counterbore 304 approximately coplaner with the shoulders 316. The diameter of valve stem 338 is substantially less than the diameter of the valve body portion 330 and forms a shoulder 340 at the interface between the valve stem 338 and the valve body portion 330. Stop wings 342 extend laterally from the valve stem 338 and are appropriately positioned along the length of stem 338 to perform as set out below approximately midway along the length of the valve stem 338. The longitudinal placement of the stop wings 342 is determined by the dimension of the shoulder 307. The stop wings 342 must be sufficiently displaced from the shoulder 340 along the surface of the valve stem 338 to permit the stop wings 342 to extend above the shoulder 316 when the shoulder 340 meets the lower downwardly outwardly extending surface 307. A first shear pin 344, or collet, or other suitable mechanism for prevention of reciprocation, extends through the surface of valve collar 14" and into the base 346 of the valve portion 330 and releasably holds the valve portion 330 in its initial position.

Spring 322 is of any suitable material having an inner diameter larger than the diameter of the valve stem 338 and having a collapsed length substantially equal to the distance from the shoulder 316 to the lower surface 315 of the passageway 314.

The upper valve element 324 includes a valve base portion 350 having a diameter greater than the diameter of the bore 301. The upper valve element 324 is reduced in size along the portion extending away from the valve base portion 350 to form a valve stem portion 352 having a smaller diameter than bore 301 with a shoulder 354 formed at the juncture of the valve stem portion 352 and the valve base portion 350. Two grooves 356, 358 are formed along the circumference of the valve stem portion 352 spaced such that circumferential seals 360, 362 may be fit therein and sealingly engaging the walls of bore 301 and the walls 364, 366 respectively of the valve stem portion 352. Grooves 356, 358 are spaced apart sufficiently so that the seals 362, 366 engage the walls on either side of the passage 137 when the shoulder 354 abuts the shoulder 368 formed between the counterbore 302 and the bore 301. A shear pin 369, or collet, or other suitable mechanism for prevention of reciprocation, extends through the surface of valve collar 14" and into a bore 370 formed in the valve stem portion 352 upon initial assembly and releasably holds the valve stem portion 352 in its initial position.

Referring to FIGS. 3A–3C, in operation the pressure from the bore 21 of the pipe member 11 is applied through the passageway 54 against the surface 372 of the upper valve body element 324. At the same time, pressure in the borehole external to the valve collar 14" is applied via passageway 303 to the areas defined by seals 362 and 334 in the pocket. Pressure in the borehole external to the valve collar 14" is applied via the packing element 30 and the passageway 236 to the other side of seal 334 and is applied via the packing element 30 and to the passageway 137 to the portion of the bore 301 located between the seals 360 and 362. When the pressure within tubular pipe member 11 is sufficient to overcome the shear strength of the shear pin 369, the shear pin 369 shears (FIG. 3B) permitting the pressure acting on the surface 372 to move the second valve body member 324 longitudinally towards second valve body member 320 and to compress the spring 322. Accordingly, the valve seal 360 no longer prevents flow of fluid from the passageway 54 to the passageway 137, and fluid then flows to passageway 137 from passageway 54. Fluid passageway 137 flows into channel 20 and thence to the interior of the packing element 30 and inflates the packing element 30. Fluid communication with the interior of the packing element 30 is accomplished through the passageway 236 equal to the pressure within the packing element 30. It will be noted that the pressure area across the seal 334 is larger than the pressure area across the seal 356 and thus when the fluid in the passageway 236 has reached a predetermined pressure, greater than or equal to the pressure in the passageway 303, as determined by the shear force of the shear pin 344, the shear pin 334 shears (FIG. 3C) forcing the second valve body member 320 to rise or move and the end surface 373 of the second valve body member 320 to abut the surface 374 of first valve body member 324. Because the surface area of the surface 346 is substantially greater than the surface area of the surface 372, the pressure in the passageway 236 acting on the surface 346 will eventually force both the second valve body member 320 and the first valve body member 324 to move through their respective bores until the shoulder 340 on the second valve body member 320 contacts the inclined surface 307. At this point, the seals 360, 362 on the second valve body member 320 would be again spaced around or to either side of the passageway 137 to prevent further flow of fluid into the passageway 137 from passageway 54 thereby retaining the inflation pressure in the packing element 30. Should there be a small loss in pressure in the passageway 236 against surface 346, the wings 342 (which can be optional) would prevent the valve body member 320 and the valve body member 324 from moving sufficiently to again permit flow between the passageways 54 and 137.

Although the system described in detail above is most satisfactory and preferred, many variations in structure and method are possible. For example, wings 342 may be eliminated. Also, the members may be made of any material suitable for the environment. Further, reciprocating member or valve body member 324 may be split horizontally so that the member has two pieces, each piece having one seal and the lower seal being of a poppet type.

The above are examples of the possible changes or variations.

Because many varying and different embodiments may be made within the scope of the inventive concept herein taught and because modifications may be made in accordance with the descriptive requirements of the law, it should be understood that the details herein are to be interpreted as illustrative and not in a limiting sense.

What is claimed as invention is:

1. In system for use in packing off a well bore, comprising a tubular mandrel;

an inflatable packing means attached to said mandrel at one end of said mandrel having an interior portion separated from said mandrel and an inlet means to said interior portion;

inflation valve means mounted on the other end of said mandrel having an interior portion separated from said mandrel and having passageway means therethrough, said inflation valve means and said passageway means being in fluid communication with said inlet means to said packing means and to the interior of said packing means and to the interior and exterior of said mandrel;

said passageway means having valve pocket means in said inflation valve means, said valve pocket means being in fluid communication with the interior of said mandrel, with the exterior of said mandrel, with the interior of said packing means, and with said inlet means to said packing means;

valve means in said valve pocket means including a valve having a first reciprocating valve member, said first reciprocating valve member having a first seal for sealingly engaging said first reciprocating valve member and the wall of said valve pocket means and being mounted in said valve pocket means with one side in fluid contact with fluid from the interior of the packing element to prevent fluid flow therefrom, said first reciprocating valve member being exposed on the other side of said seal to fluid contact with fluid from the exterior of said mandrel, first stop means for preventing reciprocation of said first reciprocating valve member prior to the application of at least a predetermined positive differential pressure between fluid in the interior of the packing means and fluid in the exterior of said packing means.

2. The system of claim 1 wherein there is further included:

a second reciprocating valve member, said second reciprocating valve member having a second seal and third seal disposed on said second reciprocating valve member to sealingly engage the wall of said second reciprocating valve member and said valve pocket means, one end of said second reciprocating member being in fluid contact with fluid from the interior of the mandrel and the other end of said second reciprocating member being in fluid contact with fluid from the exterior of said mandrel, second stop means for preventing reciprocation of said second reciprocating valve member prior to the application of at least a predetermined positive differential pressure between fluid in the interior of the mandrel and fluid at the exterior of the mandrel, said seals being positioned on said second reciprocating valve member and disposed relative to each other thereon for preventing the flow of fluid from either end of said second reciprocating valve member to said inlet means when said second stop means prevents reciprocation of second reciprocating valve member.

3. The system of claim 2 wherein there is further included:

third stop means for preventing reciprocation of said second reciprocating valve member in one direction beyond said initial position of said seals.

4. The system of claim 3 wherein there is further included bias means for urging said second reciprocating valve member toward said third stop means.

5. The system of claims 1, 2, 3 or 4 wherein there is further included prevent means for preventing the return of said first reciprocating valve member to its initial position after it reciprocates in said valve pocket means.

6. A system for use in packing off a well bore, comprising:

a tubular mandrel;

inflatable packing means attached to said mandrel at one end of said mandrel having an interior portion separated from said mandrel and an inlet means to said interior portion;

inflation valve means mounted on other end of said mandrel and having passageway means therethrough, said inflation valve means and said passageway means being in fluid communication with said inlet means to said packer means and to the interior and exterior of said mandrel;

said passageway means having valve pocket means in said inflation valve means, said valve pocket means being in fluid communication with:

the interior of said mandrel, the exterior of said mandrel, and said inlet means to said packing means;

valve means in said valve pocket means including at least one valve element, said valve element being mounted in said valve pocket means and having a reciprocating valve member and stop means for preventing reciprocation of said reciprocating valve member prior to the application of at least a predetermined difference in pressure between one side of said reciprocating valve member and the other side of said reciprocating valve member, said reciprocating valve member being located at one end of said valve pocket means when said stop means prevents reciprocation and having at least two seals thereon for preventing the flow of fluid from either end of said reciprocating valve member around said reciprocating valve member to said inlet means;

each of said seals on said reciprocating valve member being exposed on one side thereof to fluid from said inlet means.

7. An inflatable well packer for use in a well bore traversing earth formations where the well packer has a tubular mandrel, an inflatable packer element on said tubular mandrel with one end of the packer element attached to the mandrel and a valve collar means attached to the other end of the packer element and mandrel, the improvement comprising:

valve means and passage means in said valve collar means for selectively admitting fluid from the interior of the tubular mandrel to the interior space between said packer element and said tubular mandrel, said valve means including a first valve having spaced apart seal means on an elongated first valve element slidably received in said valve collar means for movement between first and second positions, said seal means in a first position of said valve element straddling a section of the passage means leading to said interior space between said packer element and said tubular mandrel, release means for releasably retaining said first valve element in said first position and releasable upon the application of predetermined pressure differential across said seal means to move said valve element to said second position, said valve element on one side of said seal means having access to the pressure exterior of the valve collar and having access on the other side of said seal means to the pressure in a portion of the passage means leading to the interior of said tubular mandrel so as to pressure balance said first valve element across said seal means between the interior of the tubular mandrel and the exterior of the valve collar means;

said valve means having a second valve having seal means on a second valve element slidably received in said valve collar means for movement between first and second position, means in said valve collar means for retaining said second valve element in said second position, said second valve element being movable from said first to said second position in response to the application of a predetermined pressure differential across said second valve element, said second valve element being cooperable with said first valve element so that upon movement of said second valve element to said second position, said first valve element is returned to its first position.

* * * * *